US008104701B2

(12) United States Patent
Smidt et al.

(10) Patent No.: US 8,104,701 B2
(45) **Date of Patent: *Jan. 31, 2012**

(54) APPARATUS AND METHOD FOR SUPPORTING A REMOVABLE ANVIL

(75) Inventors: Brian Smidt, Otley, IA (US); Darin Dux, Pella, IA (US); Scott Eberts, Pella, IA (US); Duane Harthoorn, Lynnville, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/313,412

(22) Filed: Nov. 19, 2008

(65) Prior Publication Data

US 2009/0072062 A1 Mar. 19, 2009

Related U.S. Application Data

(62) Division of application No. 10/783,339, filed on Feb. 20, 2004, now Pat. No. 7,461,802.

(51) Int. Cl.
*B02C 19/00* (2006.01)
*B02C 23/00* (2006.01)

(52) U.S. Cl. ..... 241/32; 241/186.35; 241/189.1

(58) Field of Classification Search ..... 241/189.1, 241/186.35, 32

See application file for complete search history.

(56) References Cited

U.S. PATENT DOCUMENTS

| | | | | |
|---|---|---|---|---|
| 2,209,277 | A | 7/1940 | Mankoff | |
| 3,170,643 | A * | 2/1965 | Hanse et al. | 241/189.1 |
| 3,823,878 | A * | 7/1974 | Ishikura | 241/69 |
| 4,119,277 | A * | 10/1978 | Snyder et al. | 241/167 |
| 4,146,184 | A * | 3/1979 | Whitney | 241/73 |
| 4,504,019 | A * | 3/1985 | Newell et al. | 241/73 |
| 4,650,129 | A * | 3/1987 | Newell et al. | 241/73 |
| 4,730,791 | A * | 3/1988 | Hausler et al. | 241/189.1 |
| 5,713,525 | A | 2/1998 | Morey | |
| 5,795,443 | A | 8/1998 | Greve | |
| 5,881,959 | A * | 3/1999 | Hadjinian et al. | 241/34 |
| 5,911,372 | A * | 6/1999 | Williams, Jr. | 241/32 |
| 5,947,395 | A * | 9/1999 | Peterson et al. | 241/32 |
| 5,975,443 | A * | 11/1999 | Hundt et al. | 241/27 |
| 6,422,495 | B1 | 7/2002 | De Boef et al. | |
| 6,474,579 | B1 * | 11/2002 | Bardos et al. | 241/88.4 |
| 6,641,065 | B2 * | 11/2003 | Bardos et al. | 241/30 |
| 6,843,435 | B2 * | 1/2005 | Verhoef et al. | 241/73 |
| 6,978,955 | B2 * | 12/2005 | Verhoef et al. | 241/223 |
| 7,461,802 | B2 | 12/2008 | Smidt et al. | |
| 2002/0056773 | A1 | 5/2002 | Zehr | |
| 2003/0141394 | A1 | 7/2003 | Ueda et al. | |

FOREIGN PATENT DOCUMENTS

| | | |
|---|---|---|
| WO | WO 03/015925 A1 | 2/2003 |

OTHER PUBLICATIONS

Horizontal Grinders HG365/HG525, PN 605508-001-1; Date: publicly known prior to the filing date of the present application; 8 pgs.

* cited by examiner

*Primary Examiner* — Bena Miller

(74) *Attorney, Agent, or Firm* — Merchant & Gould P.C.

(57) ABSTRACT

A grinding machine having a mounting arrangement and an anvil. The grinding machine generally including a feed table and a grinding drum positioned within a mill box. The mounting arrangement being configured to support an end of the feed table and the anvil. The anvil including a wedge-shaped portion and having a length. The length of the anvil being configured to extend beyond sides of the mill box.

25 Claims, 7 Drawing Sheets

APPARATUS AND METHOD FOR SUPPORTING A REMOVABLE ANVIL

CROSS-REFERENCE TO RELATED APPLICATIONS

This application is a divisional application of U.S. application Ser. No. 10/783,339, filed Feb. 20, 2004 now U.S. Pat. No. 7,461,802; which application is incorporated herein by reference.

TECHNICAL FIELD

This disclosure generally relates to horizontal grind machines, and more particularly, to an anvil and anvil support arrangement and apparatus.

BACKGROUND

The grinding of a variety of materials can have a desirable effect. For instance, grinding of some types of waste results in increased rate of decomposition, which is useful in landfill operations; grinding wood waste produces mulch that is useful in landscaping applications; and grinding asphalt is useful in recycling efforts. Some types of shingles can also be ground for use in asphalt production. The benefits of and need for such recycling processes continue to grow.

Several types of machines are used in grinding applications. One type is known as a horizontal grinder. An example of a horizontal grinder is disclosed in U.S. Pat. No. 5,881,959. Horizontal grinders typically include a horizontal feed table onto which material to be ground is placed. The feed table is capable of moving the material to a point where a feed roller begins to cooperate with the feed table. The feed roller generally presses down on top of the material, while being rotationally powered, to assist in forcing the material into contact with the side of a grinding drum.

The grinding drum is as wide as the feed table and rotationally powered on a generally horizontal axis perpendicular to the direction of travel of the feed table. The grinding drum typically includes hammers or cutters mounted to the outer perimeter of the drum to impact the material as it is fed from the feed roller/feed table. These hammers or cutters tend to propel the material either up, for grinders known as up-cut grinders, or down, for grinders known as down-cut grinders. Down-cut grinders force the material past a stationary bar, typically known as an anvil, which is in relatively close proximity to the outer swing diameter of the hammers or cutters. Because of the anvil's relative close proximity, the size of the outer swing diameter is reduced, as necessary, to travel past the anvil. Once the material passes the anvil, the material is further reduced, as necessary, to pass through a screen.

In the '959 patent, a primary anvil is positioned a slight distance from the grinding drum such that a primary grind will occur as the material is forced past the primary anvil. The material is further reduced at a secondary anvil. If the material is ungrindable, the material passes through a trap door positioned between the primary and secondary anvils. This arrangement involves several components and moving parts that add complexity to the overall design of the grinder.

An alternative design, marketed by Vermeer Mfg (Model HG525) includes a single anvil that is located in close proximity to the grinding drum such that any material that passes by this single anvil, is capable of passing through the screens. Ungrindable material is typically retained in the feed conveyor where it can more easily be removed manually. Since the grinding drum is typically rotating such that cutters mounted to the outer perimeter of the drum are traveling at a high rate of speed, any ungrindable material is subjected to highly dynamic impact loading. The dynamic impact loading is then transferred to this single anvil, or the feed table adjacent the anvil. In certain instances, the loading can be sufficient enough to damage the anvil and supporting structure. A robust, replaceable anvil and supporting structure is thus advantageous. In other cases, highly abrasive material is processed, which wears away the anvil. It is desirable to easily maintain the anvil if wear is excessive; a removable anvil facilitates such maintenance.

In general, improvement has been sought with respect to such arrangements, generally to better accommodate: ease of use, assembly, and maintenance; and improved component and equipment life.

SUMMARY

One aspect of the present disclosure relates to a grinding machine having a mill box, a grinding drum positioned within the mill box, and a feed table for transporting material to the mill box. The grinding machine includes an anvil oriented generally parallel to grinding drum. The anvil includes a first surface and a second surface that define a wedge-shaped portion. The anvil is oriented such that the first surface of the wedge shaped portion is generally aligned with the transport plane of the feed table.

In another aspect, the present disclosure relates to a grinding machine having a mill box with opposite sides and a grinding drum. The opposite sides of the mill box define a grinding width of the machine. A wedge-shaped anvil is located adjacent to the grinding drum and positioned within apertures defined in the sides of the mill box. The anvil has a length greater than the grinding width of the mill box such that the ends of the anvil extend beyond the sides of the mill box.

In yet another aspect, the present disclosure relates to mounting arrangement for a grinding machine. The mounting arrangement includes an adapter having a first support surface configured to support an end of a feed table of the grinding machine, and a second support surface configured to support an anvil of the grinding machine.

A variety of examples of desirable product features or methods are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Reference will now be made in detail to various features of the present disclosure that are illustrated in the accompanying drawings. Wherever possible, the same reference numbers will be used throughout the drawings to refer to the same or like parts.

Figure 1:
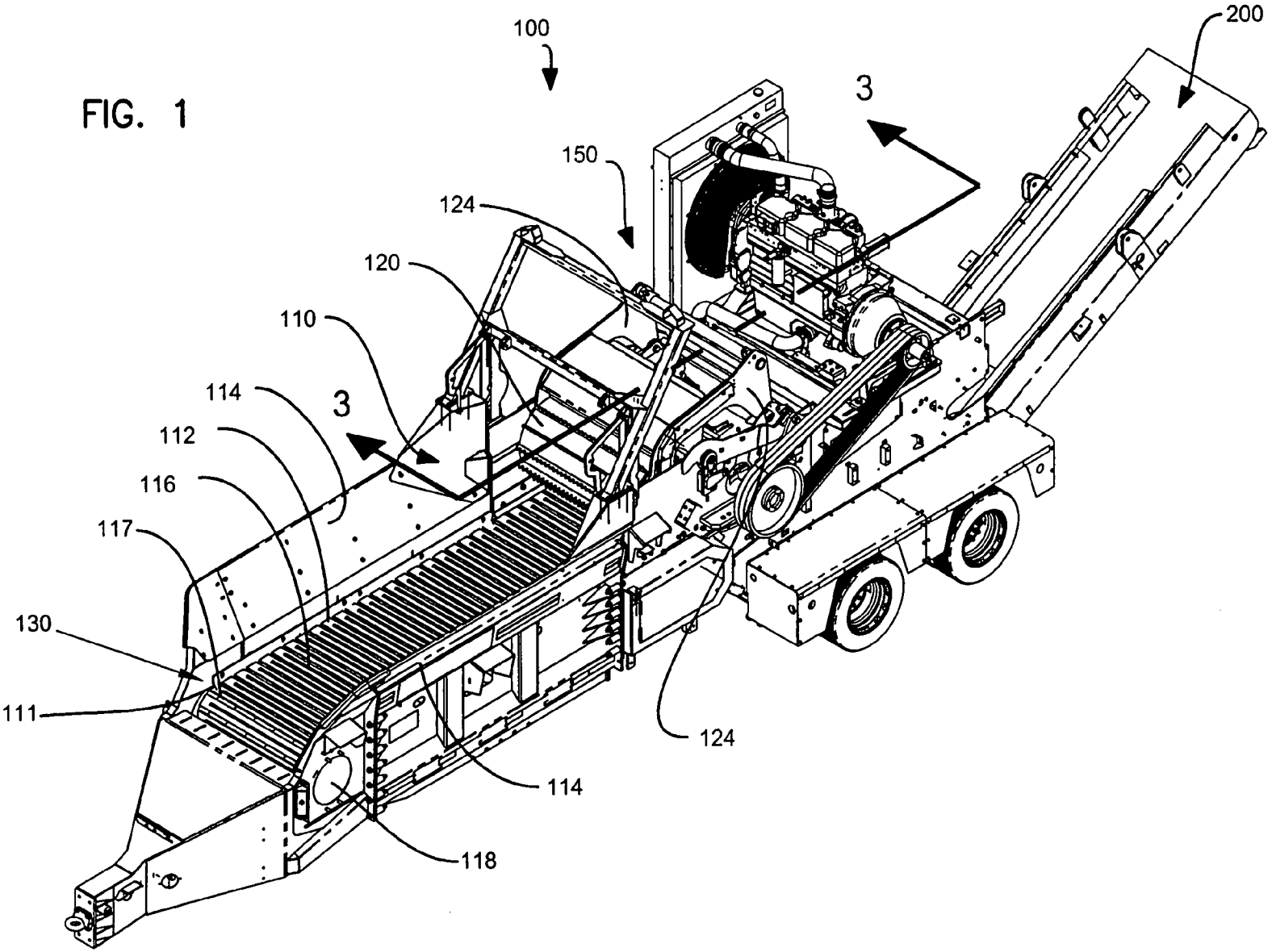
FIG. 1 is a perspective view of the left side of a materials grinder embodying various features of the present invention.

Referring to the drawings, and in particular to FIG. 1, a materials grinder 100 is illustrated. This materials grinder 100 is a horizontal grinder and includes a mill box 150 and a feed hopper 110 to transport material to the mill box 150. The materials grinder 100 can be used in a wide variety of grinding application. For, example, the material grinder 100 may be used to grind material such as leaves, shingles, small branches and is also capable of grinding larger objects such as large branches, boards, planks.

Still referring to FIG. 1, the feed hopper 110 includes a feed table 112 and sides 114. The feed table 112 defines a transport plane or bottom 111 of the feed hopper 110 onto which material is loaded for transport to the mill box 150. That is, in use, material is loaded onto the feed table 112 of the feed hopper 110, which propels the material towards a mill box 150. The feed table 112 includes a first conveyor roller 118, a second conveyor roller 202, and a conveyor arrangement 130. The conveyor arrangement 130 includes conveyor bars 116 that are attached to a conveyor chain 117. The conveyor chain 117 is routed around the first conveyor roller 118. The second conveyor roller 202 is powered, typically by a hydraulic motor, in a manner that allows the conveyor chain 117 and the conveyor bars 116 to be propelled in either direction.

The first conveyor roller 118 is supported by the sides 114 of the feed hopper 100. The second conveyor roller 202 (FIG. 2) is mounted to sides 300 of the mill box 150. Cross-members 308, 318 extend between the sides 300 of the mill box 150. In the illustrated embodiment, the cross-members 308, 318 are constructed of square tubing material. The cross-members 308, 318 provide the structure necessary to support the basic elements of the materials grinder 110, including a grinding drum 160, the second conveyor roller 202, an anvil 500, screens 180, and a feed roller 120. The first cross-member 308 is attached to each of the mill box sides 300 by a gusset 309.

Figure 2:
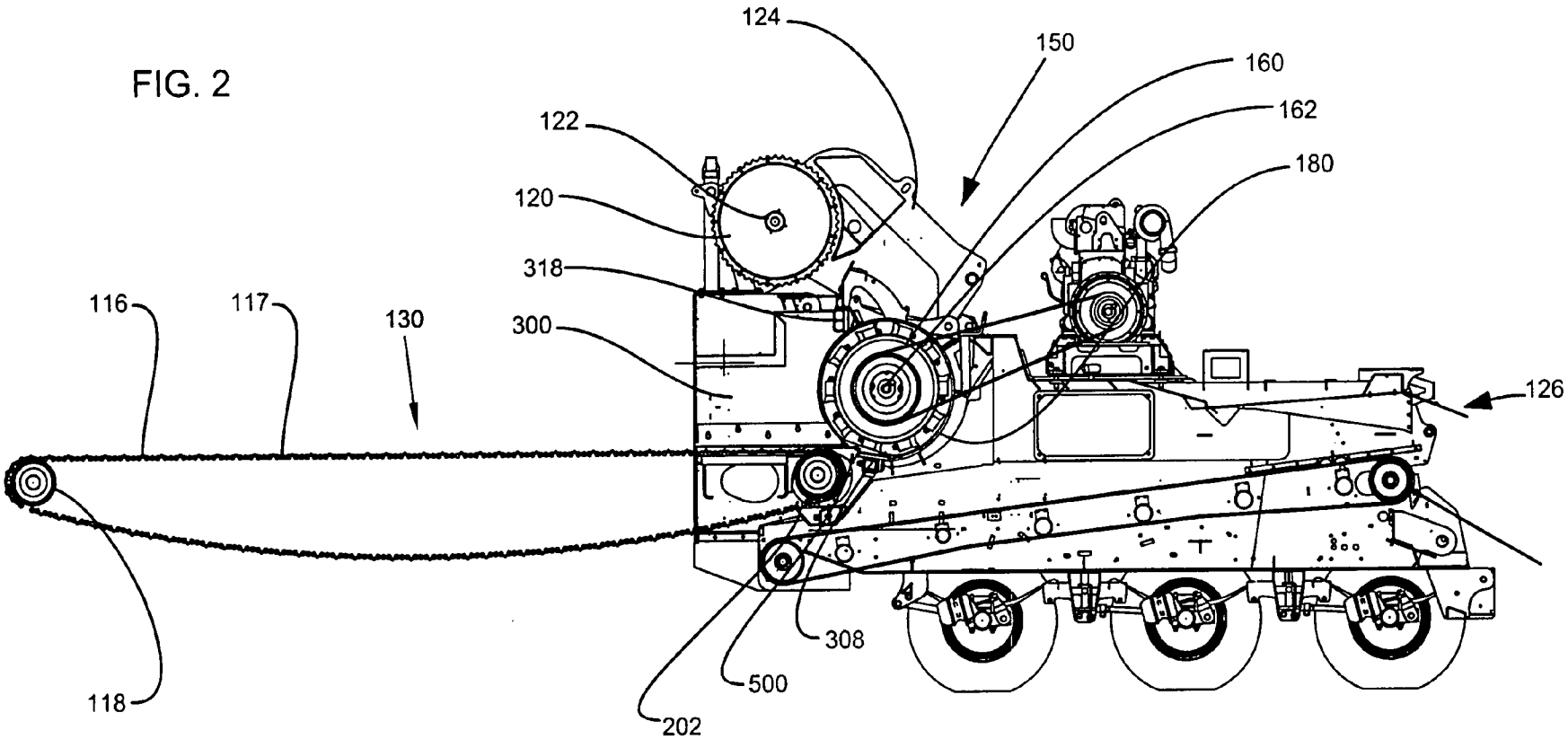
FIG. 2 is a partial left-side elevation view of the materials grinder shown in FIG. 1.

Referring now to FIGS. 1 and 2, the feed roller 120 is mounted on a feed roller shaft 122. The feed roller shaft 122 is supported on mount arms 124. During operation, material is propelled or conveyed towards the grinding drum 160 by the conveyor arrangement 130. As the material is conveyed, the feed roller 120 (driven by a hydraulic motor) engages the material to provide additional feed pressure to urge the material towards the grinding drum 160.

Figure 3:
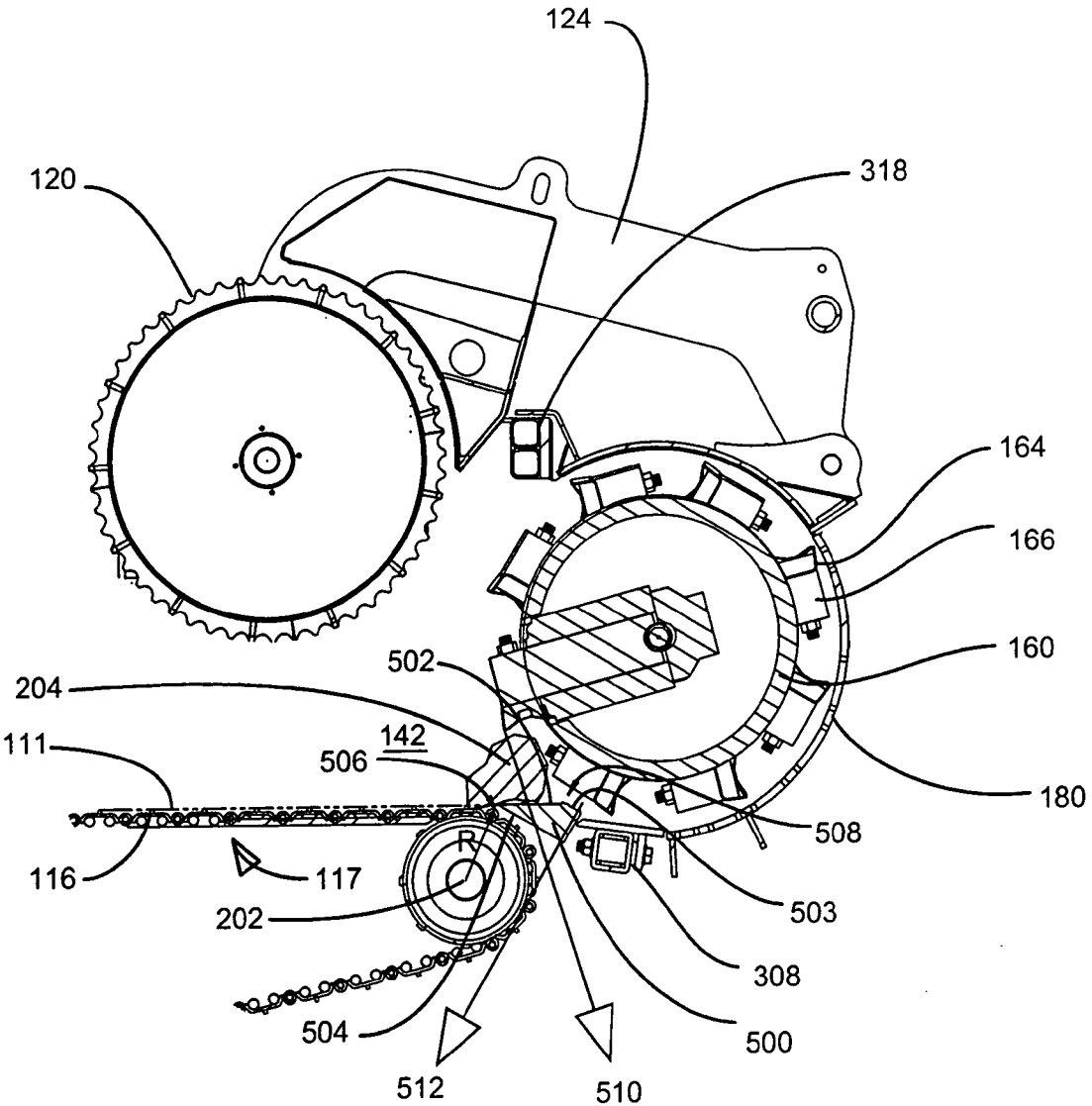
FIG. 3 is a partial cross-section of the materials grinder of FIG. 1, taken along line 3-3.

Referring now to FIG. 3, the grinding drum 160, the conveyor roller 202, and an anvil 500 are illustrated. The grinding drum 160 is similar to that disclosed in U.S. Pat. No. 6,422,495, herein incorporated by reference. The grinding drum 160 includes cutters 164 mounted on hammers 166.

Figure 9:
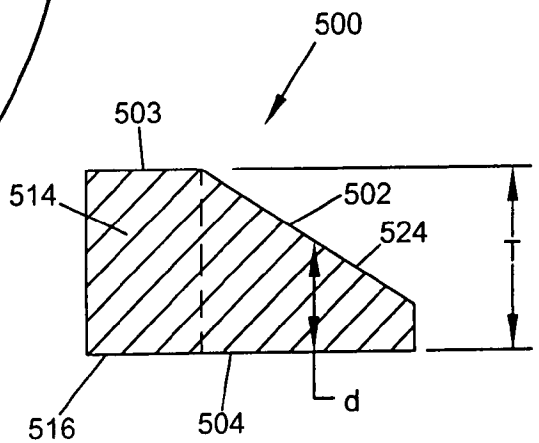
FIG. 9 is a cross-sectional view of the anvil shown in FIG. 7.

As the material approaches the grinding drum 160, the material is contacted by cutters 164 and forced into contact with the anvil 500. Referring now to FIG. 9, the anvil 500 is preferably a wedge-shaped anvil having first and second surfaces 502, 504. The first and second surfaces 502, 504 define a wedge portion 524 of the anvil 500. The material is fractured or broken upon impact with the cutters 164, or by a crushing or shearing force acting generally perpendicular to the first surface 502 of the anvil 500 (the shearing force being directionally represented by force vector 510 of FIG. 3).

Some material may be sized such that it wedges between the anvil 500 and the cutters 164 and hammers 166, thereby generating a reaction force acting generally perpendicular to a third surface 503 of the anvil 500 (the reaction force being directionally represented by force vector 512 of FIG. 3). The material that passes by the anvil 500 will be further ground to a size necessary to pass through the screens 180. Once through the screens 180, the material will exit the mill box 150 and fall onto a discharge conveyor 126 (FIG. 2) for transport to a secondary conveyor 200 (FIG. 1) where it may be further transferred to any desired position (such as to a pile beside the materials grinder 100).

Referring to FIG. 3, the primary grinding action of the present materials grinder involves the interaction of the cutters 164, which are traveling at a high rate of speed, with the stationary anvil 500. In particular, typical material, as represented by material 204, will be impacted by cutters 164 and driven down towards the anvil 500 and conveyor roller 202. The anvil 500 is placed in close proximity to the grinding drum 160 so that any ungrindable material, not able to pass by the anvil 500, will be retained at the infeed area 142, in order to prevent damage to other components including the screen 180. Upon contact with the grinding drum 160, the ungrindable materials will be forced backward, away from grinding drum 160, or will become trapped between cutters 164 and anvil 500.

If the ungrindable material becomes trapped and stops the grinding drum 160, the resulting rapid deceleration will generate significant and unusual overload forces acting against either the anvil 500, the roller 202, or a combination of both. The anvil 500, the roller 202, and the supporting framework may thus be subjected to severe loads.

The present disclosure relates to an anvil 500 having a robust configuration, and a mounting arrangement 330 for the anvil 500 and the roller 202 that permits easy maintenance of the anvil 500 and the feed table 112. Preferably, the anvil 500 is replaceable and the mounting arrangement 330 configured such that the anvil 500 is easily accessible for replacement and maintenance purposes.

Figure 4:
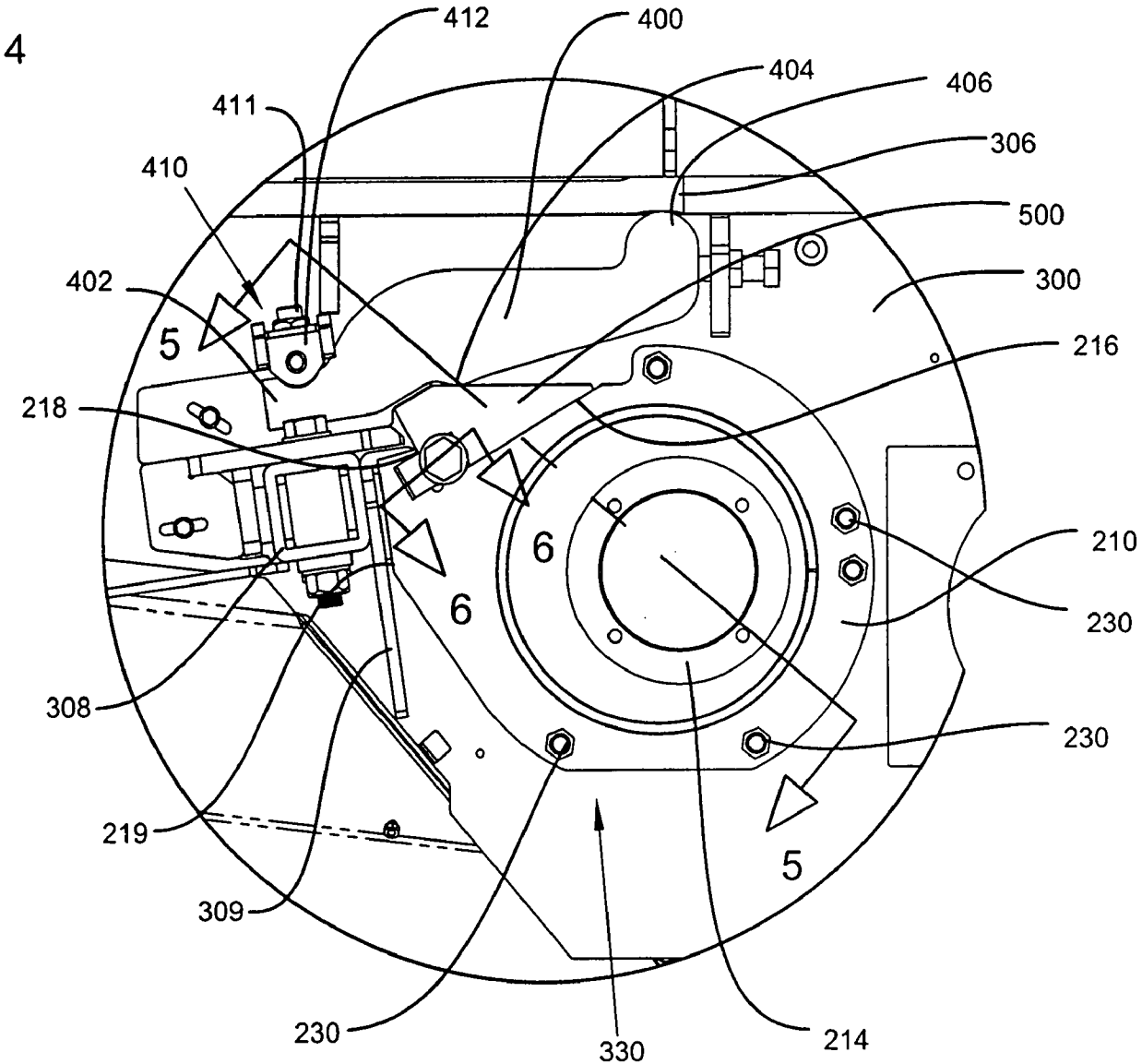
FIG. 4 is a partial right-side elevation view of the materials grinder shown in FIG. 1.
Figure 7:
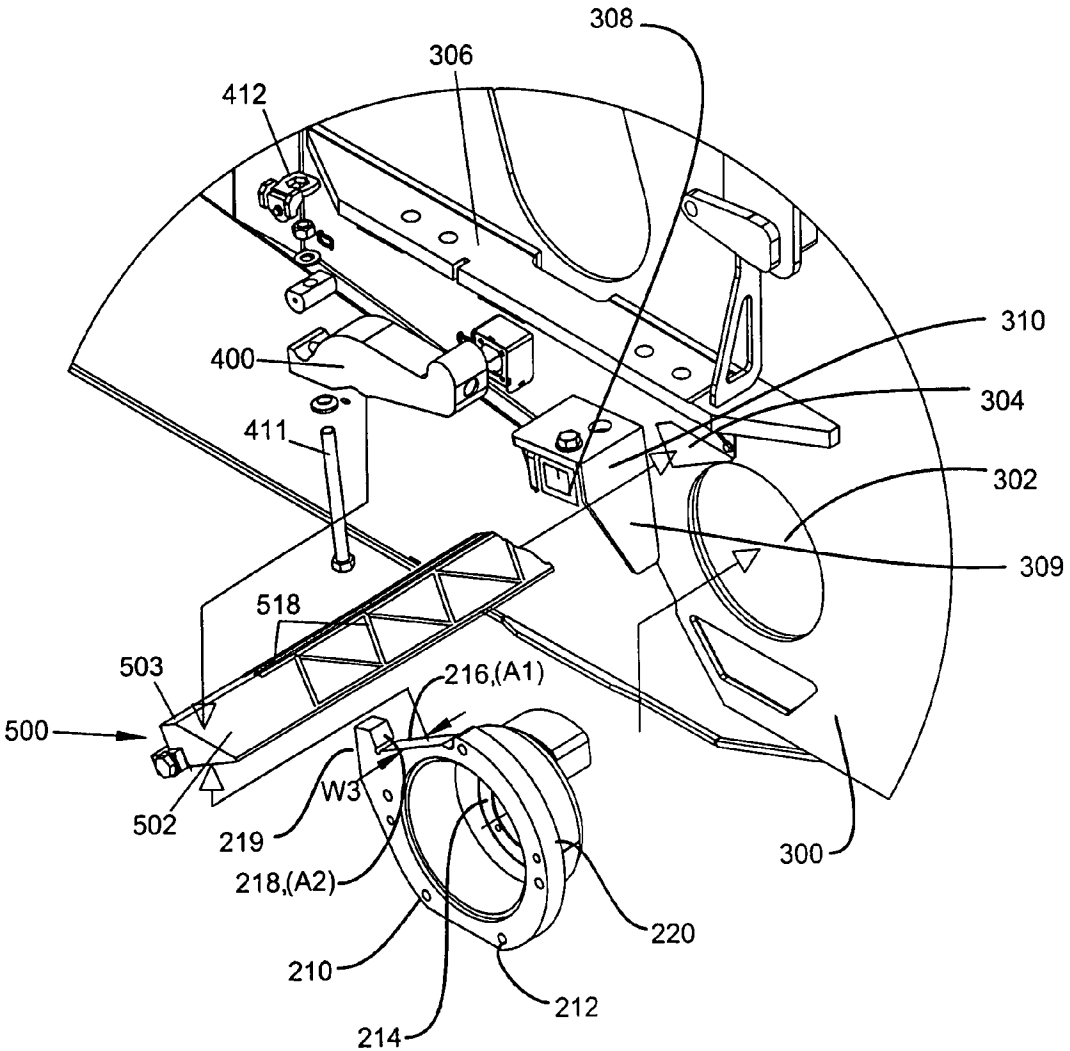
FIG. 7 is a partially exploded perspective view of the right side of the materials grinder of FIG. 1, showing an anvil, a mount, and a clamp arm of the present invention.

Referring now to FIG. 4, the anvil 500 and the mounting arrangement 330 are illustrated (the conveyor roller 202 is not shown for purposes of clarity). The mounting arrangement 330 includes adapters 210 positioned on opposite sides of the material grinder 100 (FIG. 5) such that the anvil 500 is generally parallel to an axis A-A of rotation of the grinding drum 160. Each of the adaptors 210 is mounted to an outside surface 324 (FIG. 5) of the corresponding mill box side 300 with fasteners 230. The adapter 210 is restrained in a stationary rotational orientation by a stop structure 219 that reacts against the gusset 309. In particular, the gusset 309 includes a reaction surface 310 (FIG. 7). The stop structure 219 of the adaptor 210 is configured to react with the reaction surface 310 of the gusset 309 to transfer a portion of any load applied to the anvil 500 directly to the cross-member 308. Accordingly, the cross-member 308 structurally supports the gusset 309 to maintain the adapter 201 in the stationary rotational orientation.

Referring now to FIG. 7, the adaptor 210 also includes a bearing mount surface 214 and first and second anvil mounting surfaces 216, 218. The adaptors 210 are configured to fit into apertures 302 formed in the sides 300 of the mill box 150. Each of the adaptors 210 includes a flange 220 having holes 212 to receive the fasteners 230 that secure the adaptor to the corresponding mill box side 300.

The anvil 500 is structurally configured to provide sufficient rigidity that can withstand grinding forces generated during operation, and to provide adequate protection for, and to cooperate with, the second conveyor roller 202 and conveyor chain 117. As shown in FIG. 3, the first surface 502 of the anvil 500 is essentially a planar extension of the transport plane 111 of the feed table 112 (FIG. 1).

Referring still to FIG. 3, the anvil 500 is also oriented such that the second surface 504 cooperates with the conveyor chain 117. For example, as material progress toward the anvil 500, the material reaches a first nip point 506. The first nip point 506 is where the material transfers from the conveyor chain 117 to the anvil 500. At the first nip point 506, the second surface 504 is closest to the second conveyor roller 202 and the transport plane 111 of the feed table 112 to assist in lifting material off the conveyor chain 117 and reduce the amount of material carried around the second conveyor roller 202. Any material carried around the second conveyor roller 202 will drop out of the feed hopper 110 without being ground.

Still referring to FIG. 3, the clearance between the conveyor chain 117 and the second surface 504 of the anvil 500 is minimized at the first nip point 506. Preferably, the second surface 504 is a generally flat surface that lies perpendicular to a radial line R projecting from the center of roller 202 toward the first nip point 506. This orientation reduces the chance of material wedging between the second conveyor roller 202 and the second surface 504 of the anvil 500.

Referring again to FIG. 9, the wedge-shaped portion 524 of the anvil 500 is configured to resist deflection when the anvil is subjected to the force vector 510 or 512. In particular, the anvil 500 has a tapering thickness defined by a varying distance (d, for example) between the first surface 502 and the second surface 504. The thickness of the wedge shape anvil 500 increases to a maximum thickness T at a point where the first surface 502 defines a second nip point 508 (FIG. 3). The second nip point 508 is where there is minimum clearance between the anvil 500 and the grinding drum 160. In the illustrated embodiment, the maximum thickness T is between 2 inches and 6 inches, preferably between 4.5 inches to 5 inches.

Referring again to FIG. 3, the orientation of the first surface 502 affects the performance of the grinder; for instance if the first surface 502 is arranged higher than the feed table 112, or if the first surface is angled upward such that nip point 508 is higher than nip point 506, as compared to the bottom plane 111 of the feed table, the feeding characteristics will be negatively affected. Thus, preferably, the first surface 502 of the anvil 500 is generally aligned with the bottom plane 111 of the feed table. That is, the first surface 502 of the anvil 550 is oriented generally parallel to the bottom plane 111 of the feed table such that nip point 508 is aligned with nip point 506. In an alternative embodiment, the first surface 502 may be oriented to angle downward such that nip point 508 is lower than nip point 506.

The anvil 500 also has a generally rectangular cross-section portion 514 (partially represented by a dashed line) to provide additional rigidity to the overall structure. The rectangular cross-section portion 514 is in part defined by an extension 516 of the second surface 504 and the third surface 503 of the anvil 500. As shown in FIG. 9, the third surface 503 of the anvil 500 extends at an angle from the first surface 502. The third surface 503 is oriented generally parallel to the second surface 504.

The geometry and structural orientation of the disclosed anvil 500 in relation to the other components of the materials grinder 100 are important to provide proper function while simultaneously providing adequate structural rigidity. For example, the relative position of the anvil 500 and the conveyor roller 202 at the first nip point 506; the clearance between the anvil 500 and grinding drum 160 at the second nip point 508; the orientation of the first surface 502 of the anvil 500 relative to the feed table 112 and the grinding drum 160; the orientation and increasing clearance of second surface 504 of the anvil 500 relative to the second conveyor roller 202; and the overall thickness of the anvil are all features that contribute to the structural enhancement of the disclosed materials grinder 100. In the preferred embodiment, the wedge-shaped anvil 500 is a solid construction that further enhances structural rigidity. That is, the anvil 500 is made of a construction that has no through holes, for example. The solid construction of the presently disclosed anvil eliminates stress concentrations associated with through holes or other similar structures that may weaken the structural integrity of the anvil.

In addition to the shape of the anvil 500, the anvil is preferably constructed of a material that provides mechanical properties suitable to withstand load and wear conditions experienced during operation. In one embodiment, the anvil can be constructed of a high yield strength alloy steel, such as a steel marketed as T-1® by Bethlehem Steel having a minimum yield strength of 100,000 psi. In the illustrated embodiment, the anvil 500 includes beads of hardface weld material 518, illustrated in FIGS. 5 and 7, applied to the first and second surfaces 502, 503.

Figure 5:
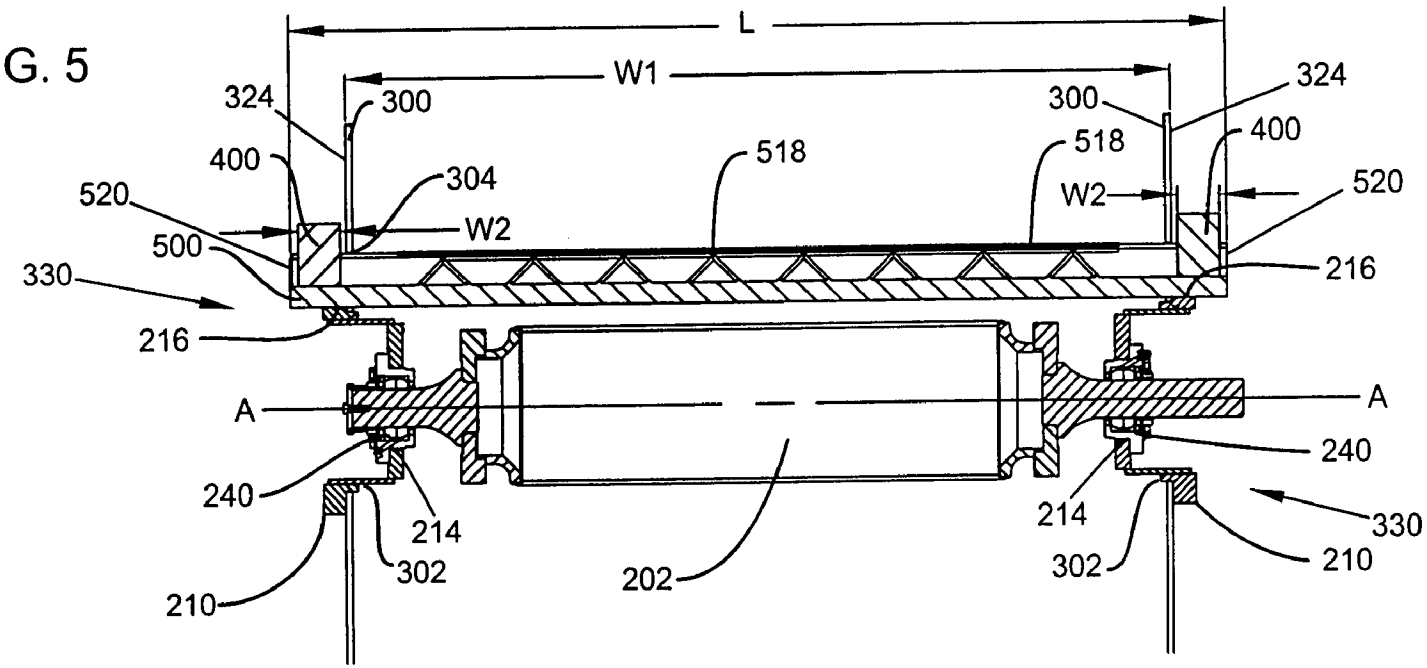
FIG. 5 is a cross-section of the materials grinder of FIG. 4, taken along line 5-5.

Referring now to FIGS. 5 and 7, the mill box sides 300 are spaced apart by the cross-members 308, 318 (FIG. 3) to define the grinding width W1 of the materials grinder 100. Each of the mill box sides 300 includes an aperture 304 configured to receive the anvil 500. The anvil 500 passes through one mill box side 300 to and through the opposite mill box side 300. In the preferred embodiment, the anvil 500 has a length L (FIG. 5) that is greater than the grinding width W1 defined by the mill box sides 300 of the mill box 150. That is, the anvil 500 is longer than the grinding width W1 such that when properly positioned, ends 520 of the anvil 500 extend beyond an outer surface 324 of the mill box sides 300. The ends 520 of the anvil 500 engage with the first and second anvil mounting surfaces 216 and 218 of each of the adaptors 210. Any forces applied to the anvil 500 are transferred to the adaptors 210.

Figure 6:
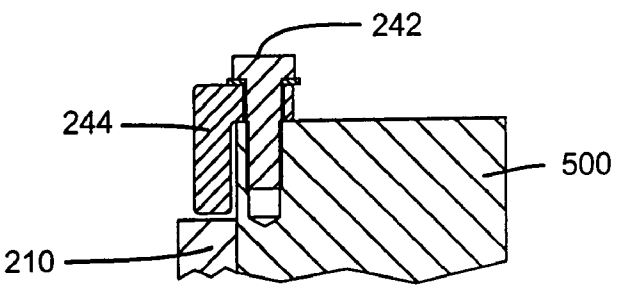
FIG. 6 is a cross-section of the materials grinder of FIG. 4, taken along line 6-6.

Referring now to FIG. 5, the mounting arrangement 330 of the present disclosure utilizes the adaptors 210 to support and position both the anvil 500 and the second conveyor roller 202. In the illustrated embodiment, the bearing mount surface 214 is an annular bearing mount surface and the first and second anvil mounting surfaces are planar surfaces. The conveyor roller 202 is rotationally supported by bearings 240. The bearings 240 are installed at the annular bearing mount surface 214 (see also FIG. 7) of the adaptors 210. The anvil 500 is supported by the first and second planar anvil mounting surfaces 216 and 218 (FIG. 7), while being positioned and retained in a direction parallel to the grinding drum axis A-A. The anvil 500 is secured in position by bolts 242 and clips 244 as shown in FIGS. 6 and 8.

Referring back to FIG. 4, the mounting arrangement 330 also includes clamp arms 400. The anvil 500 is further restrained by the clamp arms 400 having a width W2 (FIG. 5) sized and configured to provide a secure clamping force on the anvil 500. The clamp arm 400 forces the anvil 500 against the first and second anvil mounting surfaces 216 and 218 such that the anvil 500 can be described as a beam with fixed supports. Referring to FIG. 7, in order to achieve this type of mounting, the first and second anvil mounting surfaces 216 and 218 are sized to provide sufficient load carrying areas A1, A2. Preferably, each of the load carrying areas A1, A2 is defined by a width W3 of at least one inch.

Figure 8:
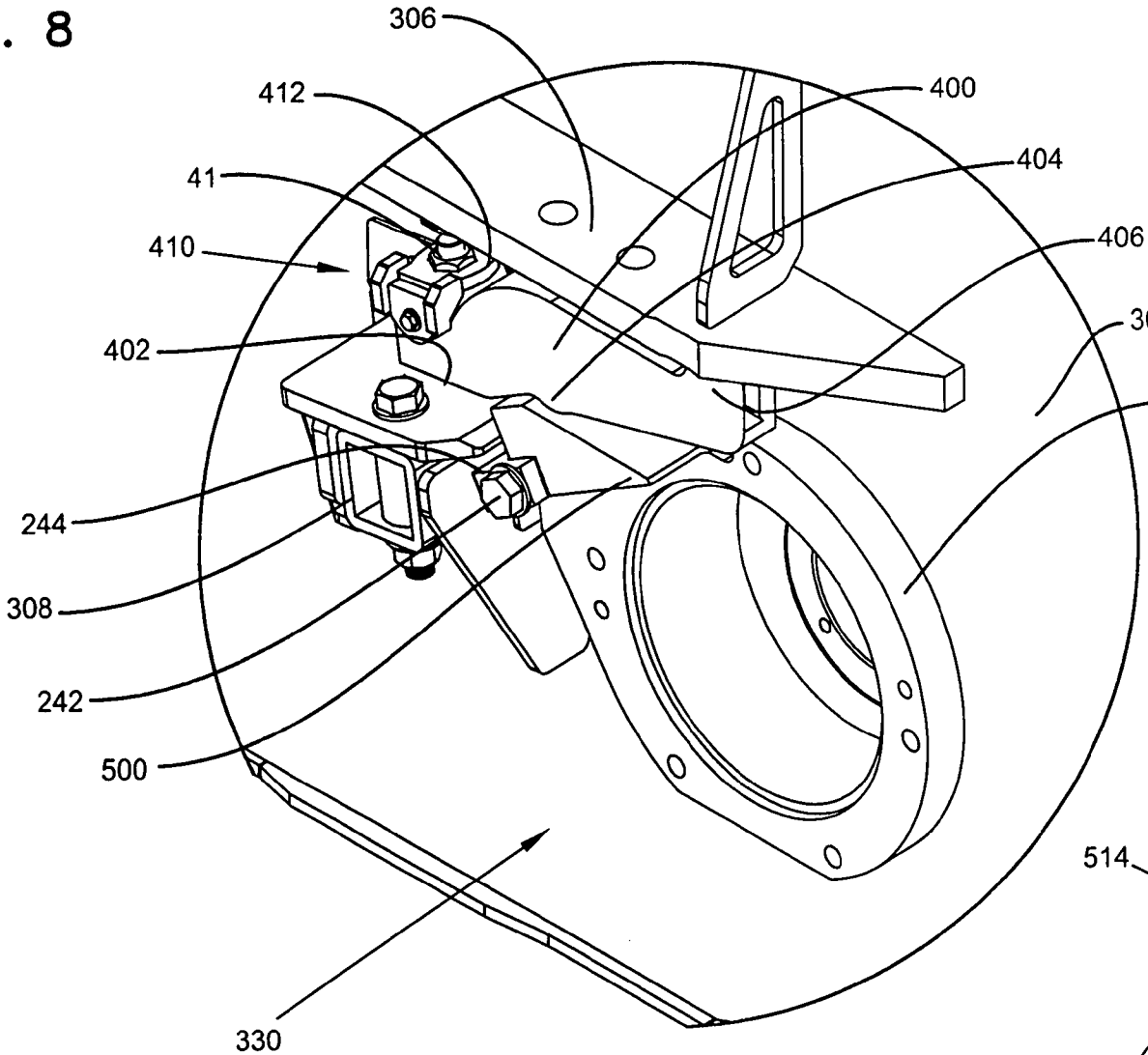
FIG. 8 is a partial perspective view of the right side of the materials grinder of FIG. 1, showing the anvil, the mount, and the clamp arm in installed positions.

Referring now to FIGS. 4 and 8, the clamp arm 400, includes a first end 402 and a second end 406. A contact structure 404 is located between the first and second ends 402, 406 of the clamp arm 400. The first end 402 of the clamp arm 400 is interconnected to an actuator 410. The actuator 410 includes a bolt 411 and a slug 412. The bolt 411 mounts the first end 402 of the actuator 410 to the first cross-member 308.

The second ends 406 of each of the clamp arms 400 are configured to react against frame members 306. Each of the frame members 306 is attached to the sides 300 of the mill box 150. In use, the clamp arm 400, bolt 411, and slug 412 are positioned generally as shown in FIG. 4 relative to the adaptor 210. The bolt 411 is then secured to the first cross-member 308. As the bolt 411 is tightened, the contact structure 404 of the clamp arm 400 contacts the anvil 500 and pivots the second end 406 of the clamp arm 400 upward. The second end 406 of the clamp arm anchors or reacts against the frame member 306 (see also FIGS. 7 and 8). This creates a clamp force against the anvil 500 at the anvil contact structure 404. The clamp force applied to the anvil 500 by the anvil contact structure 404 is transferred through the adaptor 210 creating a reaction force at the stop structure 219. The reaction force at the stop structure 219 acts against the reaction surface 310 (FIG. 8) of the gusset 309. The gusset 309 thereby transfers some of the clamp force to the cross-member 308 to which the gusset 309 is attached. In addition, some of the clamp force is transferred from the adaptor 210 to the mill box sides 300 through the frame member 306 and the bore 302.

Preferably, the mounting arrangement 330 of the present disclosure accommodates a removable and replaceable anvil 200 via the cooperative interaction of the adapter 210. Preferably, the first and second anvil mounting surfaces 214, 216, and the clamp arms 400 of the adapter 210 are located outside of the mill box sides 300 for accessibility. In accord with this feature, the clamp arm 400 secures the anvil 500 by clamping the ends 520 of the anvil 500 that extend beyond the outer surface 324 of the mill box sides 300. This provides easy access to all the securing components of the mounting arrangement 330 for easy maintenance of the anvil 500. In addition, the mounting arrangement 330 eliminates the need for welding the anvil for securing purposes. Thereby, the anvil 500 can be constructed from a wide range of materials without concern for welding compatibility.

The geometry and structural orientation of the disclosed anvil 500 interacts with the feed table 112 and with the grinding drum 160 to optimize performance of the materials grinder 100. The preferred mounting arrangement 330 allows the anvil 500 to be predictably positioned relative to the feed table 112 by incorporating into the adaptor 210 both the mount for the anvil 500 and the mount for the conveyor roller 202. What is meant by predictably positioned is that the relative positions of the feed table and anvil are dependent upon one another because each of the feed table 112 and the anvil 500 mount to a single component, i.e. the adaptor 210. The adaptor 210 is constructed and arranged such that loads applied to the anvil 500 are transferred from the anvil to the structural cross-members 308, 318 and to the mill box sides 300. This enhances the fatigue life of the anvil 500.

Various principles of the embodiments of the present disclosure may be used in applications other than the illustrated down-cut horizontal grinders. For example, the principals of the present disclosure may likewise be adapted to a tub grinder or to an up-cut horizontal grinder.

The above specification provides a complete description of the present invention. Since many embodiments of the invention can be made without departing from the spirit and scope of the invention, certain aspects of the invention reside in the claims hereinafter appended.

What is claimed is:

1. A grinding machine, comprising:

a) a mill box;

b) a grinding drum positioned within the mill box;

c) a feed table for transporting material to the mill box, the feed table defining a transport plane;

d) an anvil oriented generally parallel to the grinding drum, the anvil having a first surface and a second surface, the first and second surfaces defining a wedge-shaped portion, the anvil being oriented such that the first surface of the wedge-shaped portion is coplanar with the transport plane of the feed table; and e) a mounting arrangement having clamp arms;

f) wherein the anvil has first and second ends, each of the first and second ends extending outside of the mill box, the clamp arms being configured to secure the first and second ends of the anvil at a location outside of the mill box.

2. The grinding machine of claim 1, wherein the first surface is aligned with the transport plane of the feed table such that the first surface is a planar extension of the transport plane of the feed table.

3. The grinding machine of claim 1, wherein the anvil is oriented to provide an increasing clearance distance between the feed table and the second surface of the anvil.

4. The grinding machine of claim 1, wherein the anvil further includes a third surface extending at an angle from the first surface.

5. The grinding machine of claim 4, wherein the first and third surfaces meet at an edge, the arrangement of the edge of the anvil in relation to the grinding drum defining a minimum clearance gap between the anvil and the grinding drum.

6. The grinding machine of claim 4, wherein the third surface is generally parallel to the second surface.

7. The grinding machine of claim 4, wherein the anvil has a maximum thickness defined between the third surface and the second surface.

8. The grinding machine of claim 1, wherein the anvil is made of a solid Construction.

9. The grinding machine of claim 1, wherein the mounting arrangement includes a first support surface configured to support an end of the feed table and a second support surface configured to support the anvil.

10. A grinding machine, comprising:

a) a mill box;

b) a grinding drum positioned within the mill box;

c) a feed table arranged to transport material to the mill box, the feed table defining a transport plane;

d) an anvil having a solid construction defined by two integral portions, the two integral portions including:

i) a rectangular portion partly defined by a rearward surface, a first surface, and a second surface opposite the first surface, each of the first and second surfaces being generally perpendicular to the rearward surface; and ii) a wedge-shaped portion partly defined by a tapering surface and the second surface;

iii) wherein the tapering surface of the anvil is positioned parallel with the transport plane of the feed table; and e) a mounting arrangement having clamp arms;

f) wherein the mill box has opposite sides, the opposite sides of the mill box defining a grinding width, each of the sides defining an aperture; and wherein the anvil is positioned within the apertures of each of the sides of the mill box, the anvil having length greater than the grinding width of the mill box such that ends of the anvil extend beyond the sides of the mill box, the clamp arms being configured to secure the ends of the anvil when positioned within the apertures of each of the sides of the mill box.

11. The grinding machine of claim 10, wherein the mounting arrangement includes a first support surface configured to support an end of the feed table and a second support surface configured to support the anvil.

12. The grinding machine of claim 11, wherein the second support surface is located outside of the mill box of the grinding machine.

13. The grinding machine of claim 10, wherein the tapering surface of the anvil is oriented such that first and second reference points are horizontally aligned with one another.

14. The grinding machine of claim 10, wherein the anvil is located in relation to the grinding drum such that during operation, the tapering surface of the wedge-shaped portion of the anvil receives impacts of generally perpendicular forces generated by the grinding drum.

15. A grinding machine, comprising:

a) a mill box having opposite sides, the opposite sides of the mill box defining a grinding width, each of the sides defining an aperture;

b) a grinding drum positioned within the mill box;

c) an anvil located adjacent to the grinding drum so as to receive grinding impact from the grinding drum, the anvil being positioned within the apertures of each of the sides of the mill box, the anvil having a length greater than the grinding width of the mill box such that ends of the anvil extend beyond the sides of the mill box; and d) a mounting arrangement configured to clamp upon the ends of the anvil that extend beyond the sides of the mill box to mount the anvil adjacent to the grinding drum when positioned within the apertures of each of the sides of the mill box.

16. The grinding machine of claim 15, wherein the anvil is wedge-shaped.

17. The grinding machine of claim 15, wherein anvil is made of a solid construction.

18. The grinding machine of claim 15, wherein the mounting arrangement includes clamp arms, the clamp arms being configured to contact the ends of the anvil when positioned within the apertures of each of the sides of the mill box.

19. The grinding machine of claim 15, further including a feed table for transporting material to the mill box.

20. A grinding machine, comprising:

a) a mill box;

b) a grinding drum positioned within the mill box;

c) a feed table for transporting material to the mill box, the feed table defining a transport plane;

d) an anvil oriented generally parallel to the grinding drum, the anvil having a first surface and a second surface, the first and second surfaces defining a wedge-shaped portion, the anvil being oriented such that the first surface of the wedge-shaped portion is generally aligned with the transport plane of the feed table; and e) a mounting arrangement having clamp arms, each clamp arm being configured to secure one of first and second ends of the anvil at a location outside of the mill box.

21. A grinding machine, comprising:

a) a mill box having opposite sides, the opposite sides of the mill box defining a grinding width, each of the sides defining an aperture;

b) a grinding drum positioned within the mill box;

c) a feed table for transporting material to the mill box;

d) an anvil located adjacent to the grinding drum so as to receive grinding impact from the grinding drum, the anvil being positioned within the apertures of each of the sides of the mill box, the anvil having a length greater than the grinding width of the mill box such that ends of the anvil extend beyond the sides of the mill box; and e) a mounting arrangement configured to clamp upon the ends of the anvil that extend beyond the sides of the mill box to mount the anvil adjacent to the grinding drum when positioned within the apertures of each of the sides of the mill box, the mounting arrangement including a first support surface that supports an end of the feed table and a second support surface that supports the anvil.

22. The grinding machine of claim 21, wherein the anvil is wedge-shaped.

23. The grinding machine of claim 21, wherein the anvil is made of a solid construction.

24. The grinding machine of claim 21, wherein the mounting arrangement includes clamp arms, the clamp arms being configured to contact the ends of the anvil when positioned within the apertures of each of the sides of the mill box.

25. The grinding machine of claim 21, wherein the second support surface is located outside of the mill box of the grinding machine.

* * * * *